US007037158B2

(12) United States Patent
Mishima

(10) Patent No.: US 7,037,158 B2
(45) Date of Patent: May 2, 2006

(54) METHOD FOR MANUFACTURING AN ELECTRON SOURCE SUBSTRATE

(75) Inventor: Seiji Mishima, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 85 days.

(21) Appl. No.: 10/665,425

(22) Filed: Sep. 22, 2003

(65) Prior Publication Data

US 2004/0058462 A1 Mar. 25, 2004

(30) Foreign Application Priority Data

Sep. 25, 2002 (JP) ..... 2002-279429

(51) Int. Cl.
*H01J 9/24* (2006.01)

(52) U.S. Cl. ..... 445/24

(58) Field of Classification Search ..... 445/23–25, 445/35, 46, 49–52, 66–67; 313/238, 240, 313/241, 243, 292; 438/20, 34; 29/592.1, 29/825, 829, 830

See application file for complete search history.

(56) References Cited

U.S. PATENT DOCUMENTS

| | | | | |
|---|---|---|---|---|
| 6,144,154 | A | 11/2000 | Yamazaki et al. | |
| 6,404,555 | B1 * | 6/2002 | Nishikawa | 359/619 |
| 6,836,304 | B1 * | 12/2004 | Sakamaki et al. | 349/106 |

FOREIGN PATENT DOCUMENTS

| | | |
|---|---|---|
| EP | 0 869 528 | 10/1998 |
| JP | 10-334837 | 12/1998 |
| JP | 11-025852 | 1/1999 |
| JP | 11-233006 | 8/1999 |

* cited by examiner

*Primary Examiner*—Evan Pert
(74) *Attorney, Agent, or Firm*—Fitzpatrick, Cella, Harper & Scinto

(57) ABSTRACT

A plurality of kinds of ink jet devices are used for different regions, respectively. For element electrode pairs arranged in the vicinity of the fixed position of a spacer for example, there is used an ink jet device having an excellent performance in drop placement accuracy, drop volume accuracy or the like. For the remaining element electrode pairs, there are used ink jet devices having an inferior performance. As a result, an electron source substrate of a high quality can be manufactured at a low cost and with a high throughput.

19 Claims, 17 Drawing Sheets

METHOD FOR MANUFACTURING AN ELECTRON SOURCE SUBSTRATE

BACKGROUND OF THE INVENTION

1. Field of the Invention

The present invention relates to a method for manufacturing an electron source substrate to be used in an electron beam device and an image forming device such as an image display device or an application of the electron beam device.

2. Description of the Related Art

The electron source substrate of this kind is provided with a plurality of electron emission elements constructing an electron emission portion. As the electron emission elements, there are generally known two kinds a thermal electron source and a cold cathode electron source. The cold cathode electron source is divided into a field emission element (FE element), a metal-insulator-metal element (MIM element), a surface-conduction electron-emitting element (SCE element), and so on.

FIG. 16 is a diagram showing an element construction of M. Hartwell as a typical element construction of the surface-conduction electron-emitting element. In FIG. 16: numeral 1 designates a substrate; numerals 2 and 3 element electrodes; numeral 4 a conductive thin film; and numeral 5 an electron emission portion.

The surface-conduction electron-emitting element thus constructed has an especially simple structure of the cold cathode electron source and can be easily manufactured. Therefore, the surface-conduction electron-emitting element has an advantage that a multiplicity of elements can be formed over a wide area.

The application of the surface-conduction electron-emitting elements has been investigated to find an image forming device such as an image display device or an image recording device, or a charge beam source.

Especially as the application to the image display device, there has been investigated an image display device that combines the surface-conduction electron-emitting elements and a fluorescent member for emitting a light when irradiated with an electron beam, for example, as disclosed in U.S. Pat. No. 5,066,883. The image display device using the surface-conduction electron-emitting elements and the fluorescent member in combination has characteristics superior to those of image display devices of other types in the conventional art.

As compared with a liquid crystal display device, which has become more widespread in recent years, for example, the above-mentioned device is superior in that it requires no back light because it is of a self luminescence type and in that it has a wide angle of view. Because of the simple structure, moreover, the above-mentioned image display device is expected to be applied especially to image forming devices having a large area.

In the image forming device having a large area, generally speaking, there is frequently adopted the construction in which a spacer is arranged between a rear plate having an electron source substrate and a face plate having a fluorescent member or an anode member. The space between the rear plate and the face plate is made to be a vacuum so that the atmospheric pressure may be supported by the spacer having a sufficient mechanical strength thereby to keep the plate distance constant. The role of the spacer is the more important as the screen of the image forming device has the larger area.

Here, this spacer may exert influences on the orbits of electrons to fly between the rear plate and the face plate. The cause for influencing the electron orbits is the charge of the spacer. This spacer charge is thought to result either because a portion of the electrons emitted from the electron source or the electrons reflected on the face plate come into the spacer so that secondary electrons are emitted from the spacer, or because the ions ionized by the collisions of the electrons attach to the spacer surface.

When the spacers is positively charged, the electrons flying near the spacer are attracted by the spacer so that the display image is distorted near the spacer. The influences of this charge become the more prominent as the distance between the rear plate and the face plate becomes larger.

As methods for preventing this problem, there have been known a method for forming electron orbit correcting electrodes at the spacer and a method for removing the charges by making the charge face conductive to feed a little current.

The Applicant has investigated the application of the technique of an ink jet device to the manufacture of the electron source substrate having the surface-conduction electron-emitting elements. In this technique, a metal-containing solution is applied in the state of liquid droplets to a substrate thereby to form a conductive thin film, and an electron emission portion is formed in the conductive thin film. Then, an electron source substrate of a large area can be manufactured at a high throughput by applying a plurality of liquid droplets simultaneously with an ink jet device having a plurality of nozzles.

However, the following problems are left unsolved in the aforementioned manufacturing method.

The nozzles belonging to the ink jet device are not always constant in their distances. Therefore, the individual nozzles are different in the liquid droplet application position (i.e., the drop placement) of the metal-containing solution. As a result, the positions of the electron emission portions to be manufactured may vary, resulting in a degradation of the image quality. If this variation occurs, especially at such a portion of the screen that displays important information, e.g., the central portion of the screen, the degradation of the image quality is easily recognized, causing a problem for the display device. In the case of the aforementioned display device using the spacer, on the other hand, even slight positional displacement of the electron emission portions near the spacer at the time of manufacturing exerts serious influences on the electron orbits, thereby distorting the display image, so that the image quality is seriously degraded.

In order to avoid these disadvantages, therefore, it is conceivable to form the electron source substrate of a large area by using an ink jet device having an extremely high accuracy, which has little difference in the liquid droplet applying positions of the individual nozzles. In this case, however, the production yield of the ink jet device itself drops so that the cost for the electron source substrate also rises disadvantageously.

In EP 869528 A (corresponding to JP-A-H10-334837), moreover, the Applicant has clarified that the distortion of the display image can be eliminated by adjusting the arrangement distance of the electron emission portions near the spacer. For example, in case the conductive thin films are to be formed as a whole by the ink jet device having a plurality of nozzles, however, the positions of the electron emission portions cannot be individually controlled, making it difficult to form the electron source substrate of a high quality at a high throughput.

SUMMARY OF THE INVENTION

The present invention has been conceived in view of the circumstances thus far described and has an object to provide a technique for manufacturing an electron source substrate of a high quality at a low cost and with a high throughput.

An electron source substrate manufacturing method of the invention for achieving the above-specified object has been conceived by the keen investigations for solving the aforementioned problems.

Specifically, a method for manufacturing an electron source substrate according to the invention comprises the steps of: forming a plurality of electrode pairs over the substrate; forming conductive films by applying liquid droplets containing a conductive substance between each of the plurality of electrode pairs using a plurality of kinds (i.e., at least two kinds) of ink jet devices; and forming an electron emission portion in the conductive film.

Here, at the time of applying the liquid droplets, for the electrode pairs arranged at a predetermined region there may be used an ink jet device of a kind different from that for the electrode pairs arranged at the remaining regions. In short, specific kinds of ink jet devices are properly used for specific regions.

In the electron source substrate of the construction, in which the anode member can be arranged to confront the spacer, for example, at least for the electrode pairs arranged in the vicinity of the fixed portion of the spacer, there is used an ink jet device of a kind different from that for the remaining electrode pairs.

In the electron source substrate to be used in the image display device, alternatively, at least for the electrode pairs arranged at the central portion of the screen, there is used an ink jet device of a kind different from that for the electrode pairs arranged at the end portions of the screen.

By thus using different kinds of ink jet devices for (1) the electrode pairs arranged at predetermined regions or at regions required to have a high positional accuracy and (2) the remaining electrode pairs, it is possible to achieve both low cost and high throughput.

Here, the phrase "different kinds" means that the ink jet devices have different performances and specifications. For the electrode pairs arranged at the regions required to have a high positional accuracy, for example, there may be used an ink jet device that has excellent performances in drop placement accuracy or drop volume accuracy. For the electrode pairs arranged near the fixed position of the spacer, for example, there may be used n ink jet device that has a nozzle arrangement different from that for the remaining electrode pairs. Here, in order to improve the production yield of the ink jet device having the special performances and specifications it is possible to reduce the number of nozzles provided on that ink jet device, as compared to the other ink jet device(s).

The aforementioned plurality of kinds of ink jet devices may be made different from each other or may be made such that the head portions (i.e., united nozzles) of the individual ink jet devices are connected and scanned with a common control system (hereinafter called the "unit"). In either case, the throughput can be improved when the liquid droplets are simultaneously applied using a plurality of kinds of ink jet devices.

Because the invention uses a plurality of kinds of ink jet devices for different regions, respectively, as has been described hereinabove, an electron source substrate of a high quality can be manufactured at a low cost and with a high throughput.

DESCRIPTION OF THE PREFERRED EMBODIMENTS

Preferred embodiments of the invention will be exemplified in detail with reference to the accompanying drawings. The electron source substrate to be exemplified is preferably used either as an electron source of an image forming device, such as an image display device or an image recording device, or as a charged beam source.

Here, the size, material, shape and relative arrangement of the components to be described in the following embodiments are not intended to limit the scope of the invention thereto, unless otherwise specified.

First Embodiment

Figure 1:
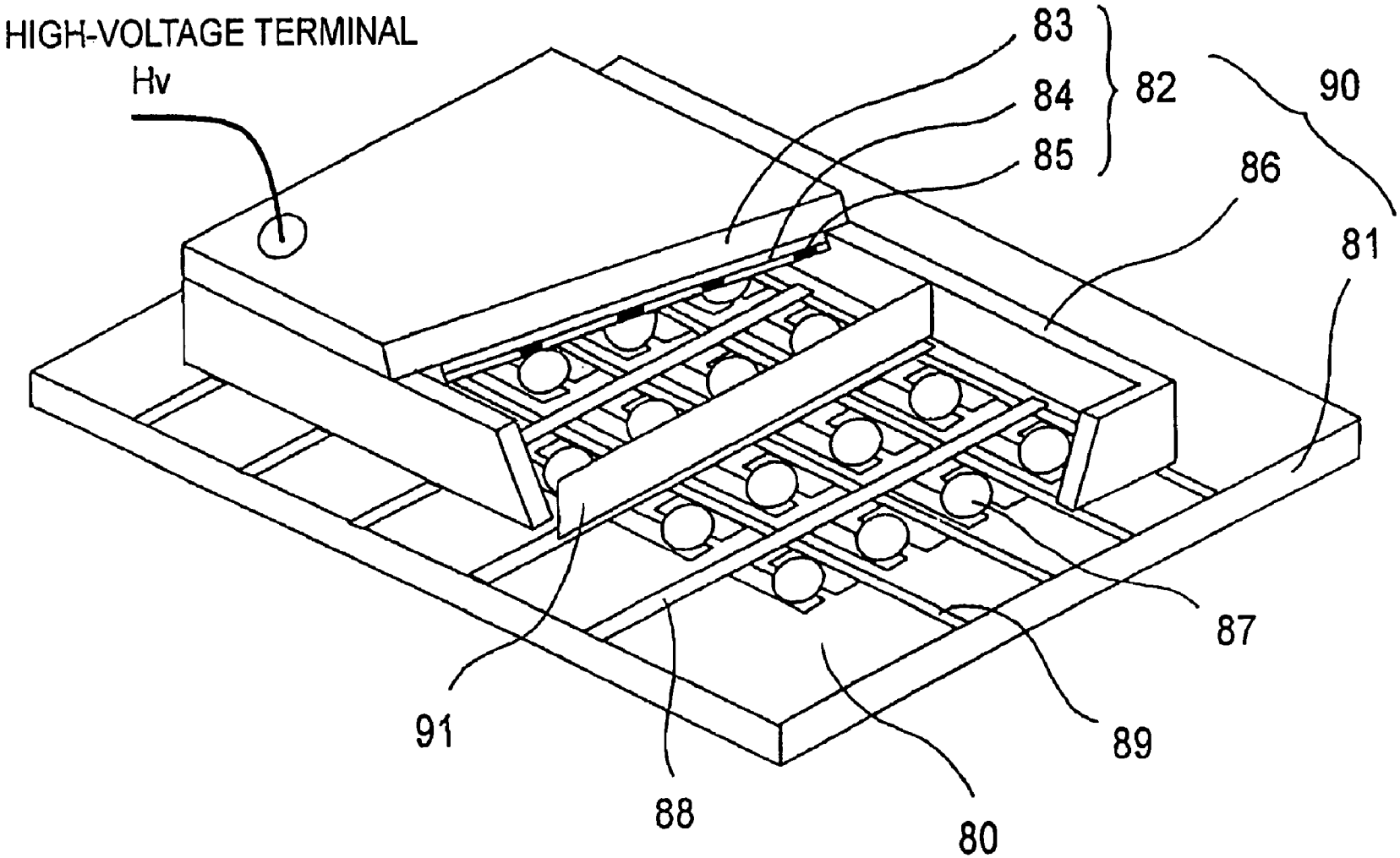
FIG. 1 is a schematic perspective view showing an image display device as an applied example of an electron source substrate.

FIG. 1 is a schematic perspective view showing an image display device as an applied example of an electron source substrate according to the first embodiment of the invention.

The image display device is schematically constructed to include a rear plate 81 and a face plate 82.

The rear plate 81 is provided with an electron source substrate 80 having a plurality of electron emission portions formed therein. This electron source substrate 80 is provided with a plurality of electron emission elements 87 arrayed two-dimensionally in the X-direction and the Y-direction, and X-direction wires 88 and Y-direction wires 89 for wiring those electron emission elements 87 in a simple matrix shape. Here in FIG. 1, only 5×4 (twenty) electron emission elements 87 are shown for simplicity of explanation. As a matter of fact, however, the electron emission elements 87 are arrayed in the order of several millions to several tens millions.

The face plate 82 is constructed such that a fluorescent film 84, a metal back 85 and so on are formed on the inner face side (i.e., the electron source substrate side) of a glass substrate 83. The metal back 85 is an anode member for receiving an acceleration voltage applied from a high-voltage terminal Hv, to accelerate the electrons emitted from the electron source substrate 80. The fluorescent film 84 is an image forming member to fluoresce when it receives the irradiation of the electron beam.

The rear plate 81, a support frame 86 and the face plate 82 are adhered with frit glass and baked at 400 to 500° C. for 10 minutes or longer so that they are sealed to form an envelope 90 of the image display device. This envelope 90 has its interior set to a vacuum state.

At this time, a support member or a spacer 91 is interposed between the face plate 82 and the rear plate 81 so that the envelope 90 may have a sufficient strength against the atmospheric pressure even in the case of a panel having a large area. The spacer 91 is fixed on a predetermined X-direction wire, as shown. By thus arranging the face plate 82 to confront the electron source substrate 80 through the spacer 91, the distance between the electron emission portion and the fluorescent film 84 can be held constant all over the screen thereby to form a satisfactory image having no distortion.

Here will be detailed the construction of the aforementioned electron source substrate and its manufacturing method.

Figure 2:
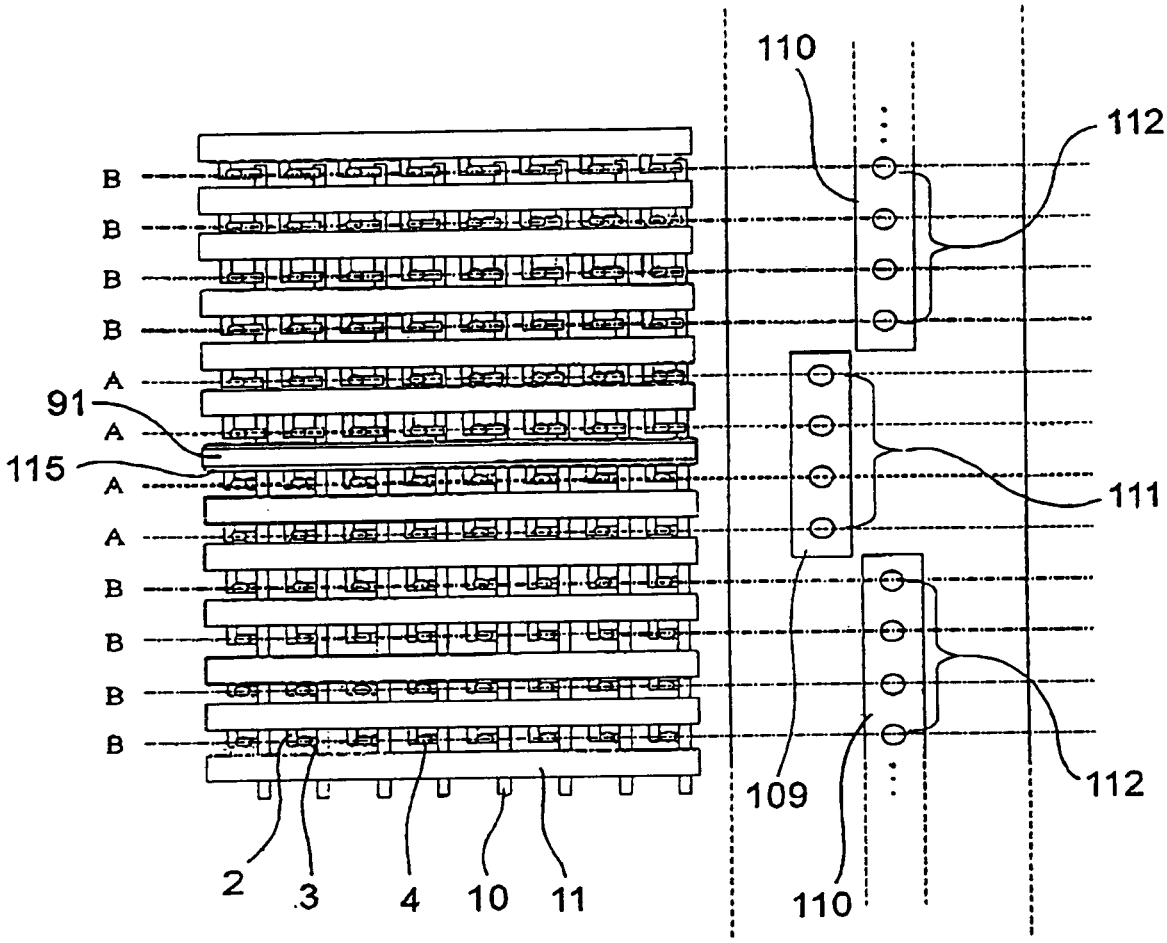
FIG. 2 is a schematic diagram showing an electron source substrate according to a first embodiment of the invention and an ink jet device to be used for manufacturing the electron source substrate.
Figure 3:
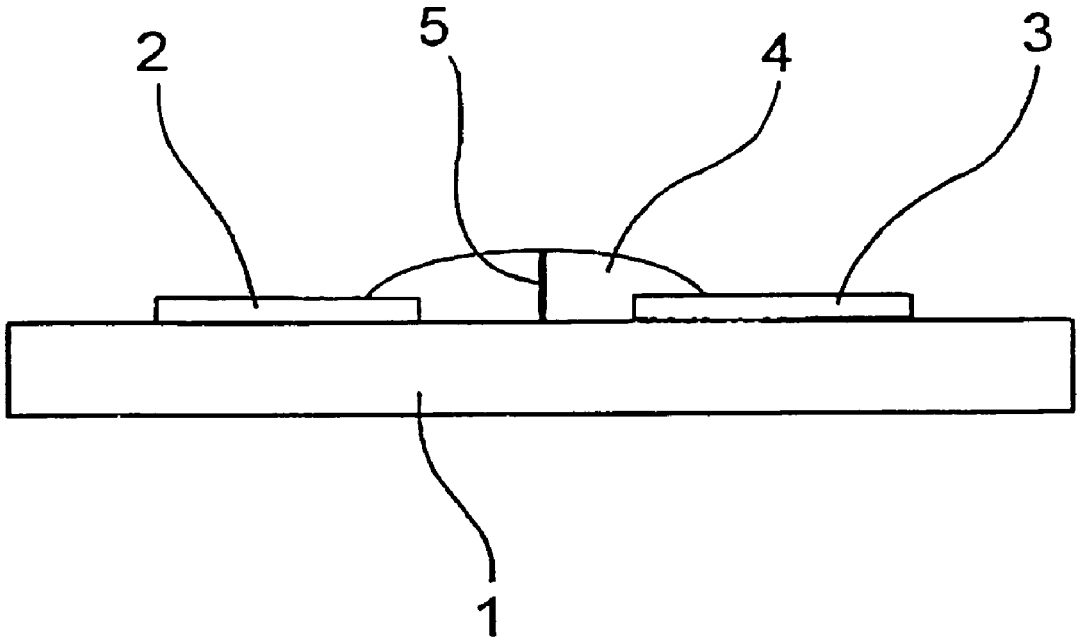
FIG. 3 is a schematic diagram showing a surface-conduction electron-emitting element constructing an electron emission portion of the electron source substrate.

FIG. 2 is a schematic diagram showing the electron source substrate and an ink jet device to be used for manufacturing the electron source substrate. FIG. 3 is a schematic diagram showing a surface-conduction electron-emitting element constructing an electron emission portion of the electron source substrate.

The electron source substrate has a construction in which a plurality of surface-conduction electron-emitting elements are arrayed two-dimensionally. Each electron emission element is constructed to include: electrode pairs composed of element electrodes 2 and 3 formed over a substrate 1; a conductive thin film 4 formed between the paired electrodes; and an electrode emission portion 5 formed in the conductive thin film 4. The element electrodes 2 of the electron emission elements arrayed in the same row of FIG. 2 are connected with the same X-direction wire 11, and the element electrodes 3 of the electron emission elements arrayed in the same column are connected with the same Y-direction wire 10.

The distance between the element electrodes 2 and 3 is preferably set to several tens of nanometers (nm) to several hundreds of microns (μm). On the other hand, the voltage to be applied between the element electrodes 2 and 3 is desirably low, and a well reproducible manufacture is required so that the especially preferable element electrode distance is several microns to several tens of microns. The length of the element electrodes 2 and 3 is preferred to be several microns to several hundreds of microns, on account of the resistance of the electrodes and electron emission characteristics. The film thickness of the element electrodes 2 and 3 is preferred to be several tens of nanometers to several microns.

The conductive thin film 4 or the portion containing the electron emission portion 5 is especially preferred to be a fine particle film composed of fine particles for achieving satisfactory electron emission characteristics. The film thickness of the conductive thin film 4 is properly set to 1 nm (10 angstroms) to 50 nm (500 angstroms), preferably, according to the element electrodes 2 and 3 and the later-described energization forming conditions. On the other hand, the sheet resistance is preferably $10^3$ to $10^7$ Ω/□. Here, the sheet resistance is defined as the resistance, which is converted to a unit thickness (mm unit) of a conductor having equal length and width.

Figure 4:
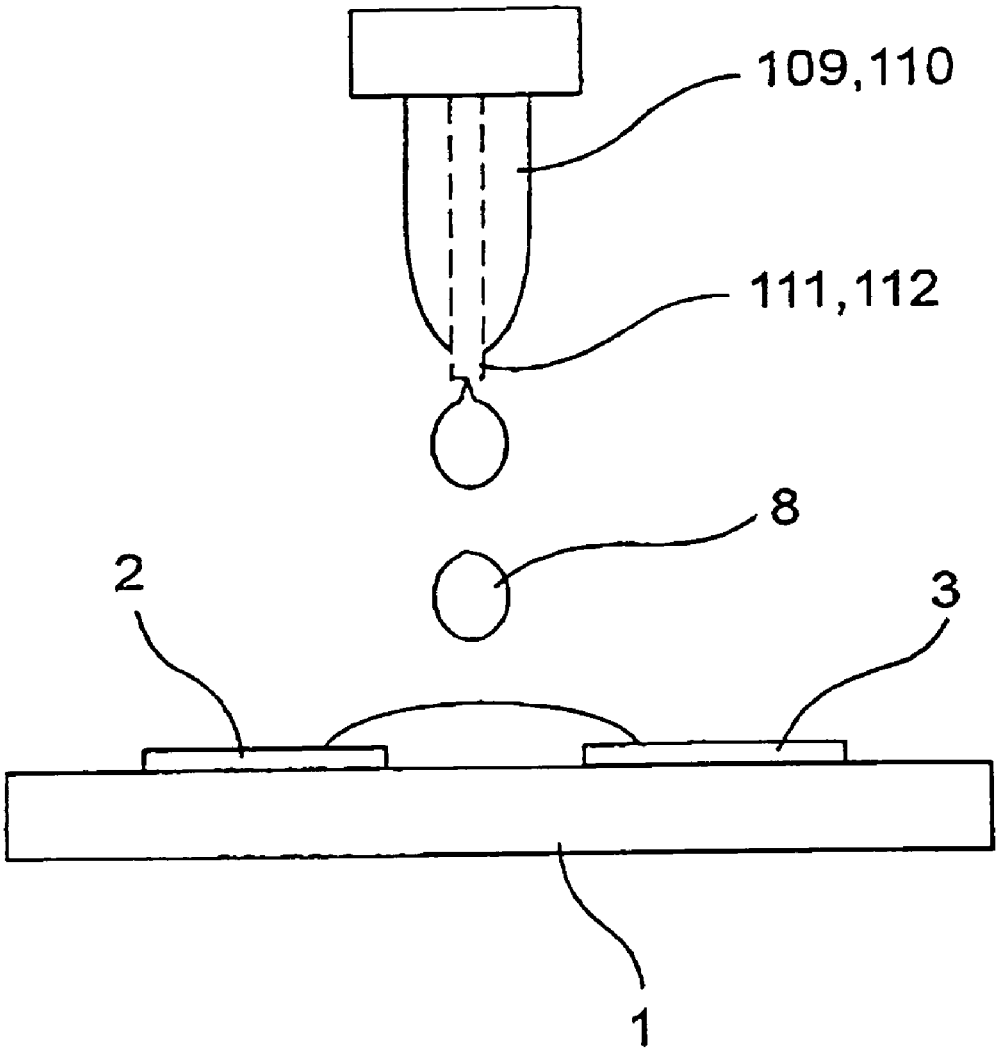
FIG. 4 is a schematic diagram for explaining a liquid droplet application by the ink jet device.

As shown in FIG. 4, the ink jet devices 109 and 110 are used to form the conductive thin film by discharging/applying liquid droplets 8 containing a conductive substance between the element electrodes 2 and 3, which are formed in advance over the substrate 1.

The ink jet devices 109 and 110 may be any such devices if they can form arbitrary liquid droplets, but are preferred to be of an ink jet system capable of controlling the drop volume (the amount of discharge) within a range of ten and several nanograms (ng) to several tens of nanograms and capable of forming liquid droplets easily in an amount as small as several tens of nanograms or more. Moreover, the material for the liquid droplets may be any if it can form liquid droplets, but can be exemplified by a solution prepared by dispersing or dissolving a metal or the like into water or a solvent, or a solution of an organic metal.

The ink jet forming system using the ink jet devices is specified by the following procedure.

Figure 5:
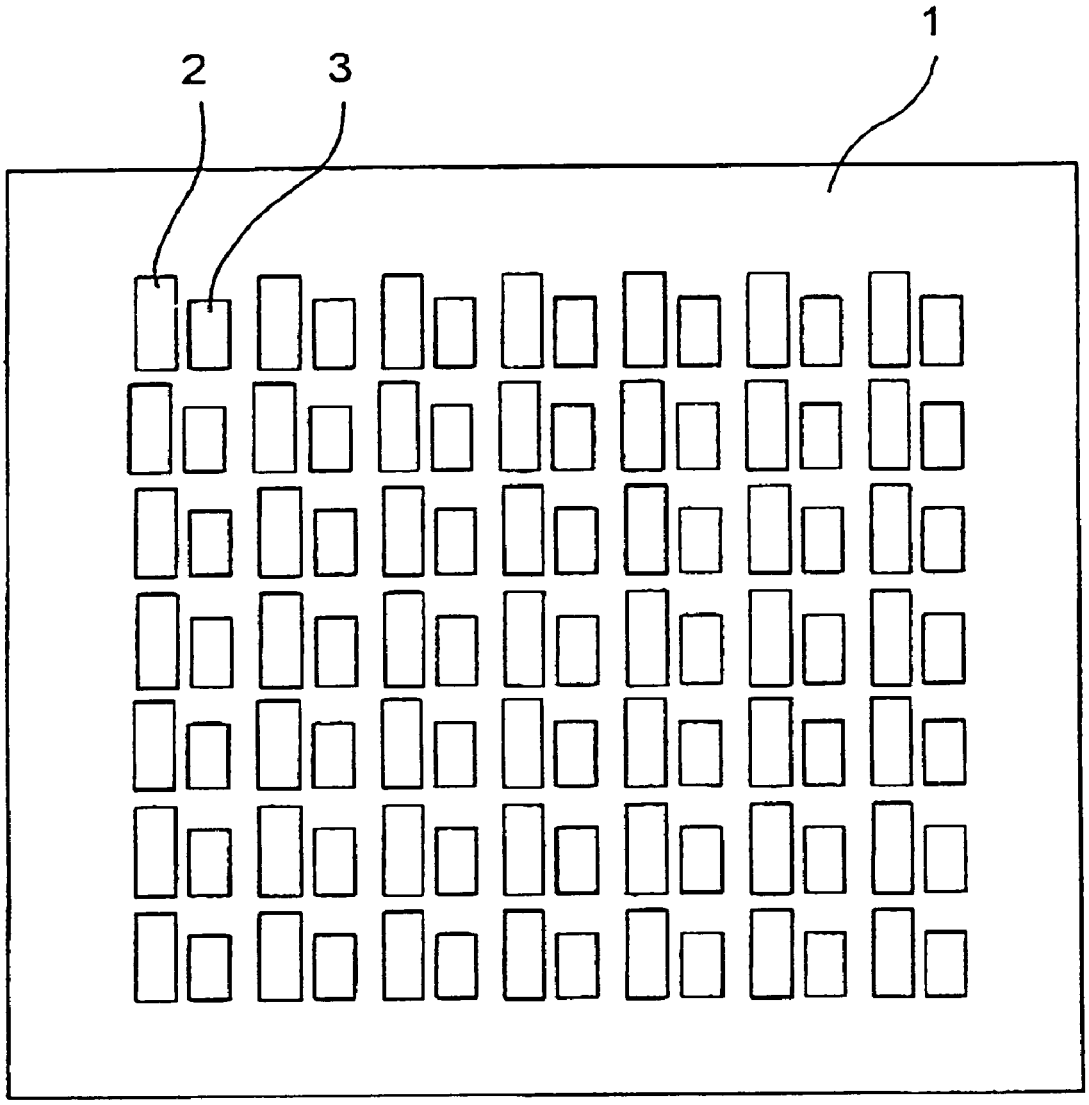
FIG. 5 is a schematic diagram for explaining a step of forming element electrodes.

First of all, the insulating substrate 1 is sufficiently rinsed with an organic solvent or the like and is dried. After this, a plurality of electrode pairs (i.e., the element electrodes 2 and 3) are formed over the substrate 1 by using a vacuum evaporation technique and a photolithographic technique, as shown in FIG. 5.

Figure 6:
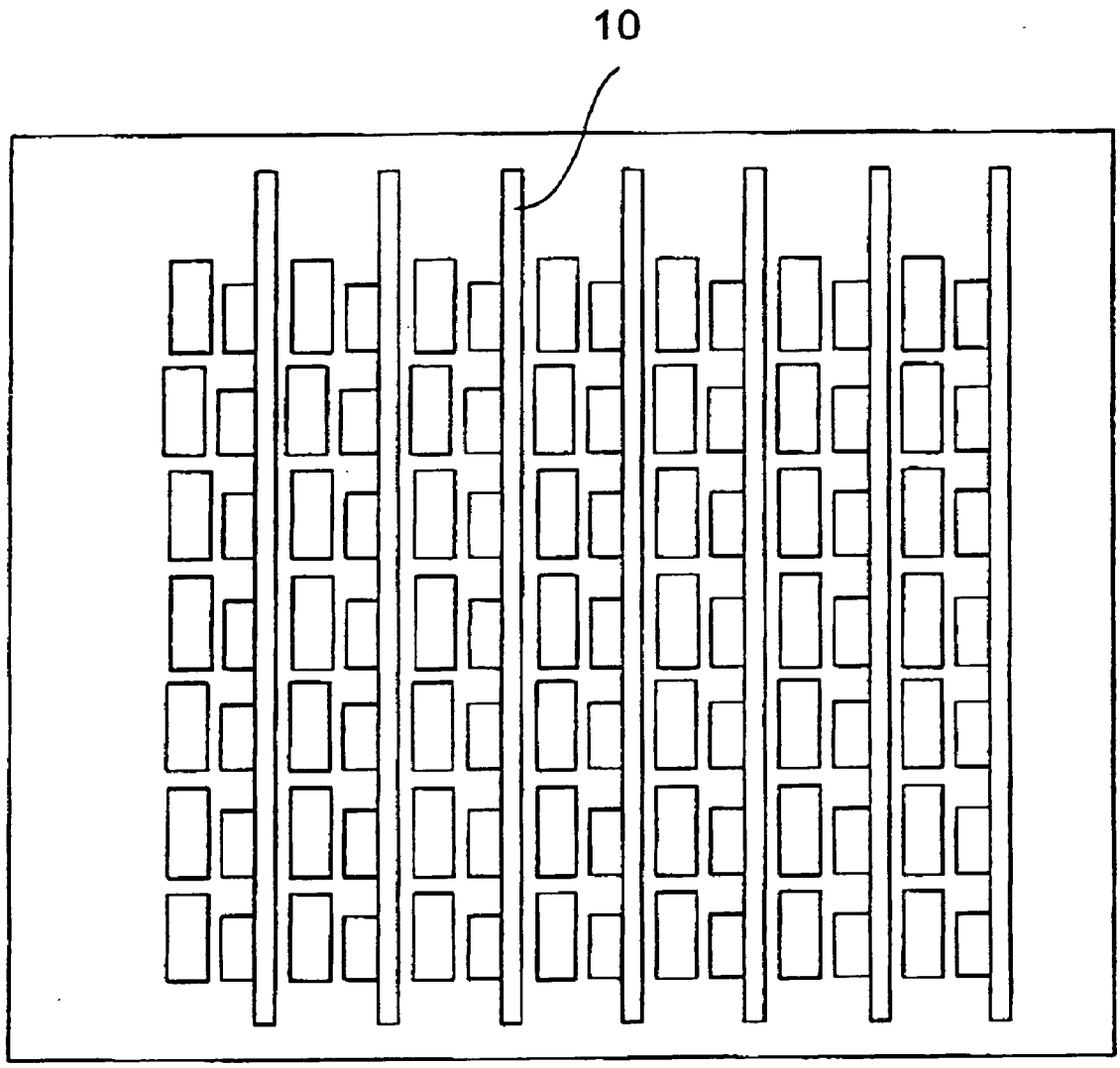
FIG. 6 is a schematic diagram for explaining a step of forming a Y-direction wiring.

Next, the Y-direction wires 10 are formed to connect the element electrodes 3 arranged in the column direction (Y-direction), electrically with each other, as shown in FIG. 6.

Figure 7:
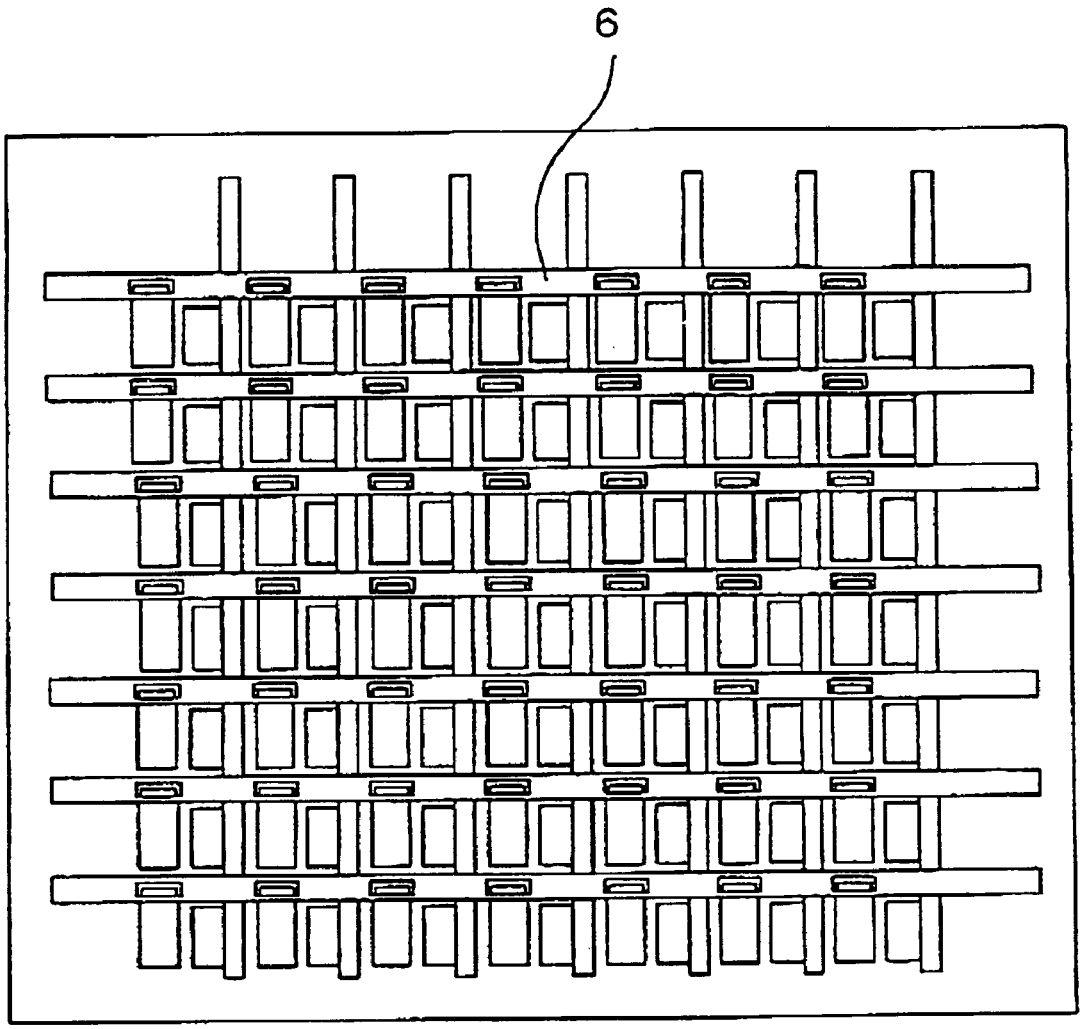
FIG. 7 is a schematic diagram for explaining a step of forming an interlayer insulating layer.

After this, an interlayer insulating layer 6 is formed, as shown in FIG. 7. This interlayer insulating layer 6 is so formed to insulate the Y-direction wires 10 and the X-direction wires 11 (to be formed at a later step) by covering the intersecting portions, at which the two wires overlap. Moreover, contact holes are formed at the connecting portions between the X-direction wires 11 and the element electrodes 2 so that they can be electrically connected.

Figure 8:
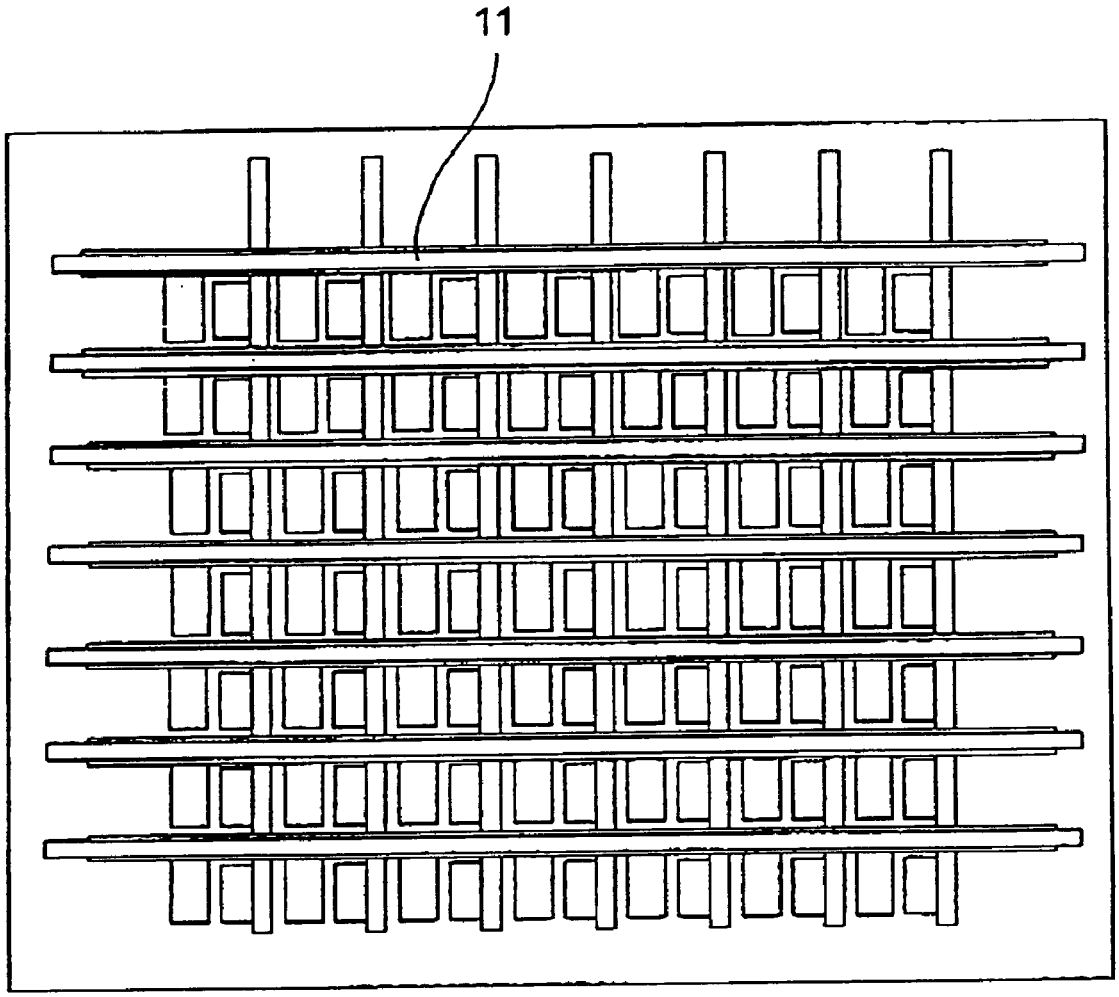
FIG. 8 is a schematic diagram for explaining a step of forming an X-direction wiring.

Subsequently, the X-direction wires 11 are formed, as shown in FIG. 8, to connect the element electrodes 2 arranged in the row direction (X-direction), electrically with each other. The substrate manufactured by the foregoing steps is called an MTX substrate (matrix substrate).

For this MTX substrate, the conductive thin films are formed by using the ink jet devices 109 and 110.

In the image display device in this embodiment, the spacer 91 is arranged on a predetermined X-direction wire (indicated by reference numeral 115 in FIG. 2). As described above, by the influence of the charge of the spacer upon the electron emission, the electron emission elements in the vicinity of the spacer, especially the electron emission elements on the row adjacent to the spacer (which will be called the "first adjacent row") and on the row next to the first adjacent row (which will be called the "second adjacent row") are curved in their electron orbits so that the image is easily distorted. As compared with the elements in the remaining regions, therefore, the conductive thin films of the elements arranged on the first and second adjacent rows are required to have a high positional accuracy. In other words, the electron emission elements arranged in the vicinity of the fixed position of the spacer have an extremely lower tolerance for displacement than that for the elements arranged in the remaining regions.

In this embodiment, therefore, at the time of applying the liquid droplets, at least for the element electrode pairs of the first and second adjacent rows arranged in the vicinity of the fixed position of the spacer, there is used an ink jet device of a kind different from those used for the remaining element electrode pairs.

Specifically, as shown in FIG. 2, there is used an apparatus that combines the ink jet device 109 and the ink jet devices 110, so that the conductive thin films of the first and second adjacent rows (indicated by A in FIG. 2) may be formed by the ink jet device 109 and so that the conductive thin films of the remaining rows (indicated by B in FIG. 2) may be formed by the ink jet devices 110.

The ink jet device 109 used here is superior in performance, such as in drop placement accuracy or in drop volume accuracy, to the ink jet devices 110. Specifically, the nozzles 112 of the ink jet devices 110 are arranged in an accuracy generally matching the interval of the rows of the above-mentioned MTX substrate, whereas the nozzles 111 of the ink jet device 109 are arranged in such a high accuracy that the conductive thin films 4 may be formed without any distortion of the image near the spacer.

The number of nozzles of the ink jet device 109 is set to such a number, e.g., four, as is necessary and sufficient for forming the conductive thin films of the first and second adjacent rows as a whole. On the other hand, the ink jet device 110 has twenty nozzles (although only four nozzles are shown in FIG. 2). The nozzles 111 and 112 of the individual ink jet devices 109 and 110 are arrayed in the direction perpendicular to the direction in which the spacer is arranged.

In the employed unit, moreover, the inkjet devices 110 are individually fixed on the two sides of the nozzle array direction of the ink jet device 109, and the liquid droplets of the material solution for forming the conductive thin film 4 are simultaneously injected/applied to a plurality of (i.e., forty four) electrode gaps by a plurality of (i.e., three) ink jet devices 110, 109 and 110.

Figure 9A:
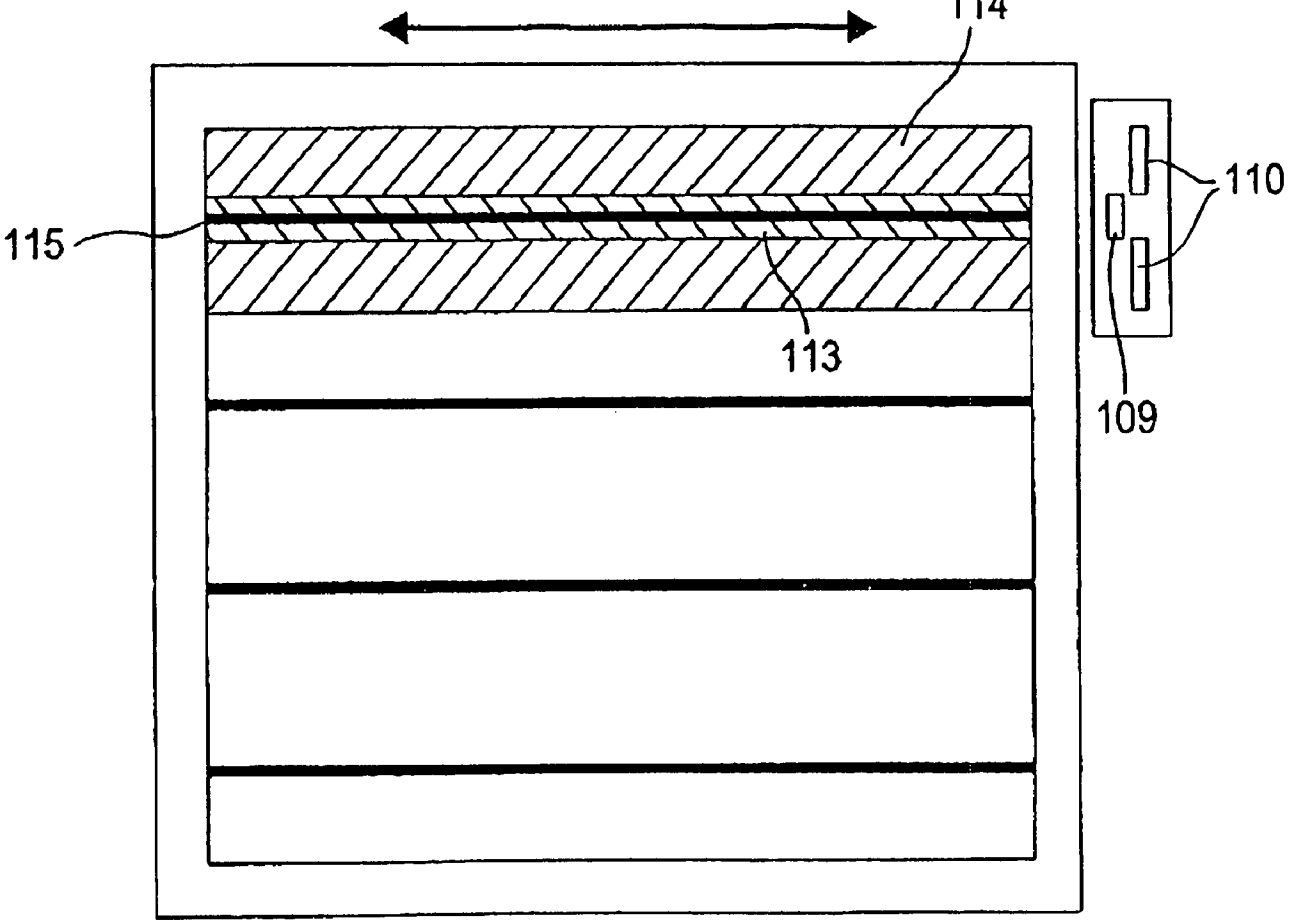
FIGS. 9A and 9B are schematic diagrams for explaining the relative movements of an ink jet device unit and a substrate.

At this time, the element electrode pairs of the forty four rows are treated as a whole at a high speed by applying the liquid droplets while moving the unit or the substrate relative to the other in the direction in which the spacer is arranged, as shown in FIG. 9A. Here in FIGS. 9A and 9B, the cross-hatched portion 113 indicates the region (i.e., the region where the liquid droplets are applied by the ink jet device 109) near the X-direction wire 115, in which the spacer is arranged, and the cross-hatched region 114 indicates the remaining region (i.e., the region where the liquid droplets are applied by the ink jet devices 110 and 110).

Figure 9B:
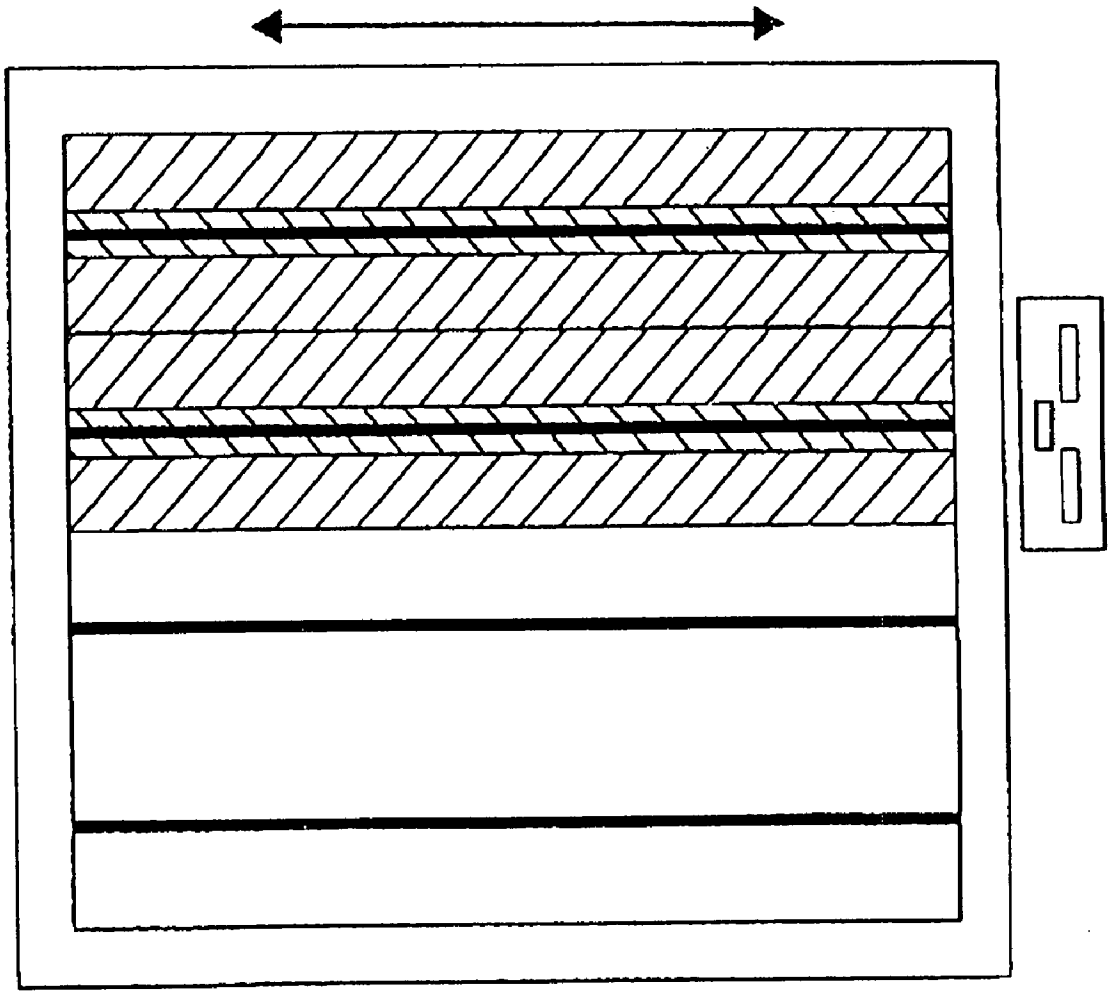
Figure 10:
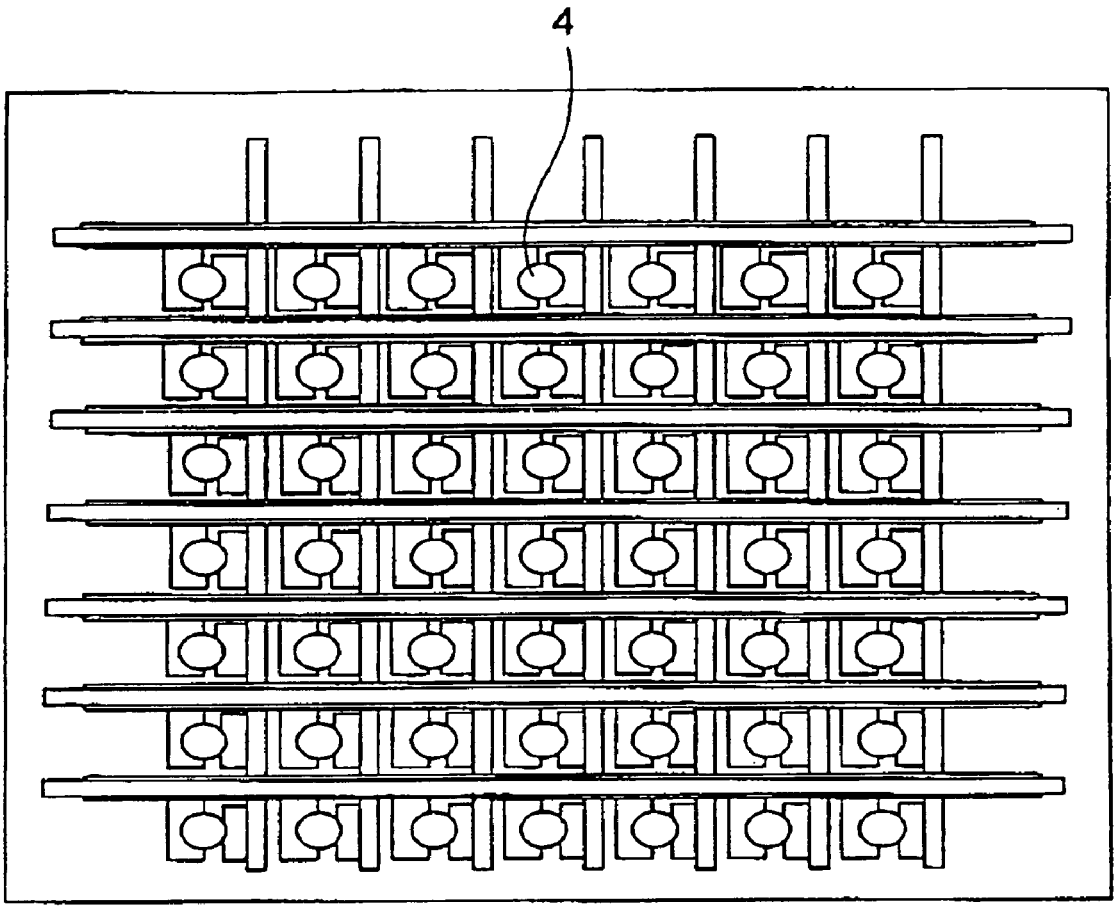
FIG. 10 is a schematic diagram for explaining a step of forming a conductive thin film.

When the treatment of the forty four rows is completed, the position of the unit is relatively offset, as shown in FIG. 9B, for the treatment of the next element electrode pairs of the next forty four rows. By repeating these operations, the liquid droplets are applied between the individual electrodes of the element electrodes pairs of the whole substrate face. After this, a heat treatment at a temperature of 300 to 600° C. is carried out to evaporate the solvent thereby to form the conductive thin films 4 (FIG. 10).

Subsequent to this, the electron emission portion 5 is formed in the conductive thin film 4. The electron emission portion 5 is a highly resistive crack formed in a portion of the conductive thin film 4, and is formed by an energization forming method or the like. This crack may contain conductive fine particles having a diameter of several hundreds of picometers (pm) to several tens of nanometers (nm). These conductive fine particles contain at least a partial element of the substance making the conductive thin film 4. On the other hand, the electron emission portion 5 and the portion of the conductive thin film 4 near the electron emission portion 5 may contain carbon or a compound thereof.

The energization forming method, for forming the electron emission portion 5, which is a portion having a modified structure, involves applying electric power between the element electrodes 2 and 3 to form the cracks in the conductive thin film 4.

Figure 11A:
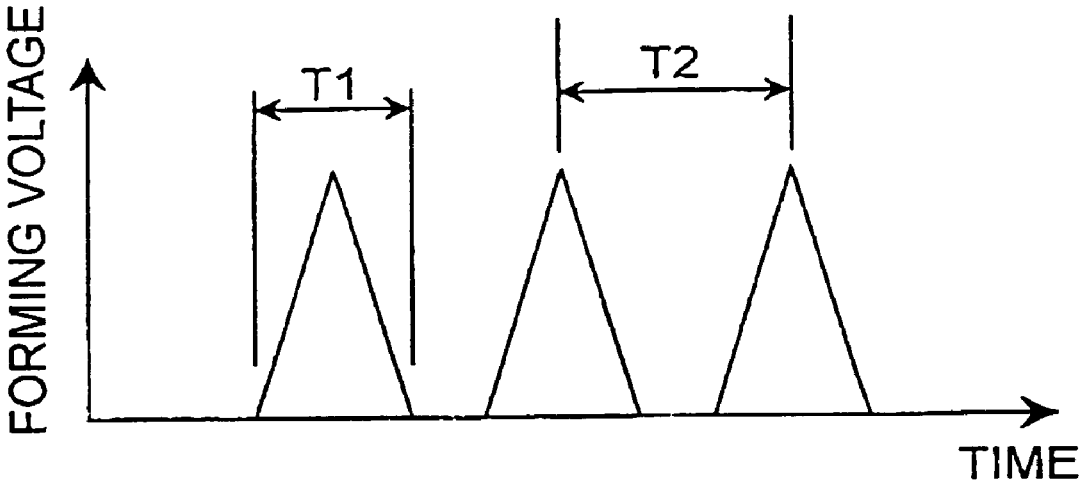
FIGS. 11A and 11B are explanatory diagrams illustrating voltage waveforms at a forming step.
Figure 11B:
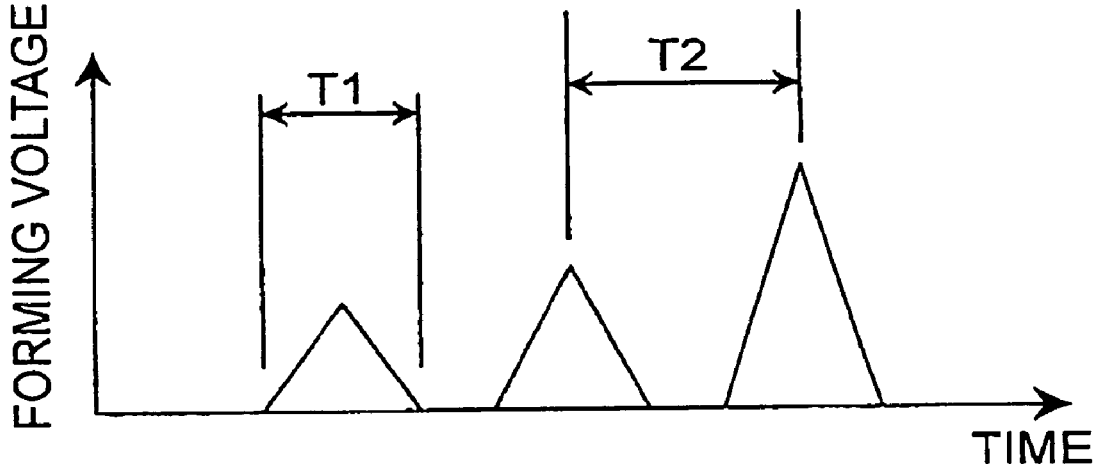

The voltage waveform to be used for the forming treatment will be briefly described. FIGS. 11A and 11B are explanatory views illustrating the forming waveforms.

Here a voltage in the form of a pulse waveform is applied. It is possible to use either of two methods properly: a method for applying pulses having a pulse peak value at a constant voltage (FIG. 11A); and a method for applying pulses while increasing the pulse peak value (FIG. 11B).

In FIGS. 11A and 11B, reference characters T1 designate a pulse width of the voltage waveform, and reference characters T2 designate a pulse interval. In the method of FIG. 11A: the pulse width T1 is set to 1 μsec to 10 msecs; the pulse interval T2 to 10 μsecs to 100 msecs; and the peak value (i.e., the peak voltage at the forming time) of the triangular waves is suitably selected. In the method of FIG. 11B, on the other hand, the magnitudes of T1 and T2 are similar, but the peak value (i.e., the peak voltage at the forming time) of the triangular waves is increased in steps of about 0.1 V, for example.

Here, the forming treatment is ended by inserting such a pulse voltage, e.g., about 0.1 V, between the forming pulses as will neither break nor deform the conductive thin film 4, and by measuring the element current. Here, the resistance is determined from the measured element current, and the forming treatment is ended at the instant when a resistance of 1,000 times as great as that before the forming treatment, or greater, is reached, for example.

In this state, the electron emission efficiency is not so high. In order to enhance the electron emission efficiency, therefore, it is desired to subject the aforementioned elements to a treatment called "activation."

This treatment is done by applying a pulse voltage repeatedly to the element electrodes from the outside through the X- and Y-wires under a suitable degree of vacuum, at which an organic substance exists. And, a gas containing carbon atoms is introduced to deposit the carbon or its compound derived therefrom, as a carbon film in the vicinity of the aforementioned cracks.

At the present step, p-tolunitrile is used as the carbon source and is introduced into the vacuum space through a slow leak valve so that it is kept at $1.3\times10^{-4}$ Pa. The pressure of the p-tolunitrile to be introduced is slightly influenced by the shape of the vacuum device or the members used in the device but is preferred to be about $1\times10^{-5}$ Pa to $1\times10^{-2}$ Pa.

Figure 12A:
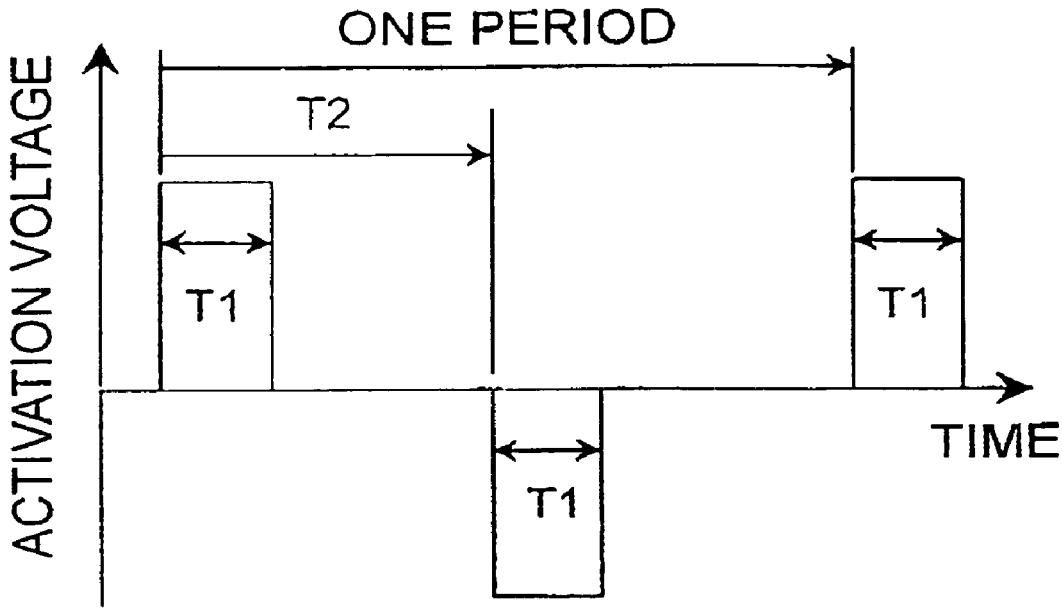
FIGS. 12A and 12B are explanatory diagrams illustrating voltage waveforms at an activation step.
Figure 12B:
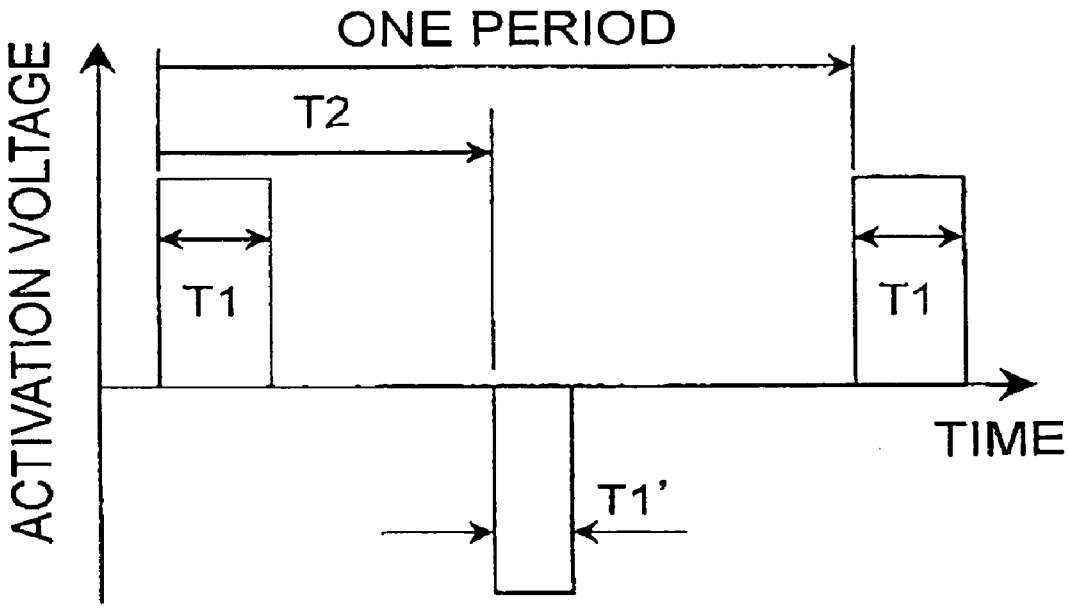

FIGS. 12A and 12B illustrate preferable examples of the voltage application to be used in the activation step. The maximum voltage value to be applied is suitably selected within a range of 10 to 20 V.

In FIG. 12A, reference characters T1 designate a pulse width of the voltage waveform, and reference character T2 designates a pulse interval. The positive voltage and the negative voltage are set to have an equal absolute value and an equal pulse width. In FIG. 12B, on the other hand: reference characters T1 designate a pulse width of the voltage waveform of the positive voltage; reference character T1' designates a pulse width of the voltage waveform of the negative voltage; and reference character T2 designates the pulse interval. The positive voltage and the negative voltage are set to have an equal absolute value and to have a relation T1>T1'. Either voltage application is possible.

At this time, the voltage to be applied to the element electrodes 3 is set to be positive, and an element current If is made positive when it flows from the element electrodes 3 to the element electrodes 2. At the instant when an emission current Ie reaches a substantial saturation at about 60 minutes after the voltage application, the power supply is interrupted, and the slow leak valve is closed to end the activation treatment.

According to the manufacturing method of this embodiment thus far described, the liquid droplets can be simultaneously applied between the individual electrodes of the element electrode pairs by using the ink jet devices 109 and 10, so that a high throughput can be realized.

Moreover, the ink jet device 109 having the superior performance is used for the element electrode pairs arranged in the vicinity of the fixed position of the spacer, so that the electron emission portion in the relevant region can be manufactured in the to a high positional accuracy. As a result, the influence from the charge of the spacer can be minimized, to suppress the distortion of the displayed image.

Moreover, the ink jet device 109 having the high performance is used for the region required to have high positional accuracy, and the ink jet devices 10 of having inferior performance are used for the remaining regions. It is therefore possible to reduce the cost for the electron source substrate manufacturing apparatus and accordingly the cost for manufacturing the electron source substrate. In short, it is possible to achieve both low cost and high throughput. Especially in this embodiment, the number of nozzles of the superior ink jet device 109 is set to the necessary minimum so that the cost can be made lower.

Moreover, the ink jet devices 109 and 110 of the different kinds are fixed into one unit by connecting their heads to each other. It is therefore possible to manufacture electron emission elements having different characteristics, such as the elements required to have positional accuracy and the elements not required to have such great positional accuracy, as a whole.

Moreover, the liquid droplets are applied while the aforementioned unit and the substrate are moved relative to each other along the direction in which the spacer is arranged. It is therefore possible to manufacture electron emission elements having different characteristics with a high throughput and remarkably simple control.

Here, in the aforementioned embodiment, the nozzle number of the ink jet device 109 is set to four. However, the nozzle number may be set to a larger value so that the liquid droplets may be applied to the regions more spaced from the spacer than the first and second adjacent rows by the superior ink jet device. By setting the nozzle number to a value less than four, on the contrary, only the first adjacent row may be covered by the superior ink jet device.

On the other hand, the number of nozzles of the ink jet device 110 is not limited to twenty, nor is the number of combined ink jet devices limited to three. The throughput can be further improved by increasing the number of nozzles and the number of ink jet devices.

Second Embodiment

Figure 13:
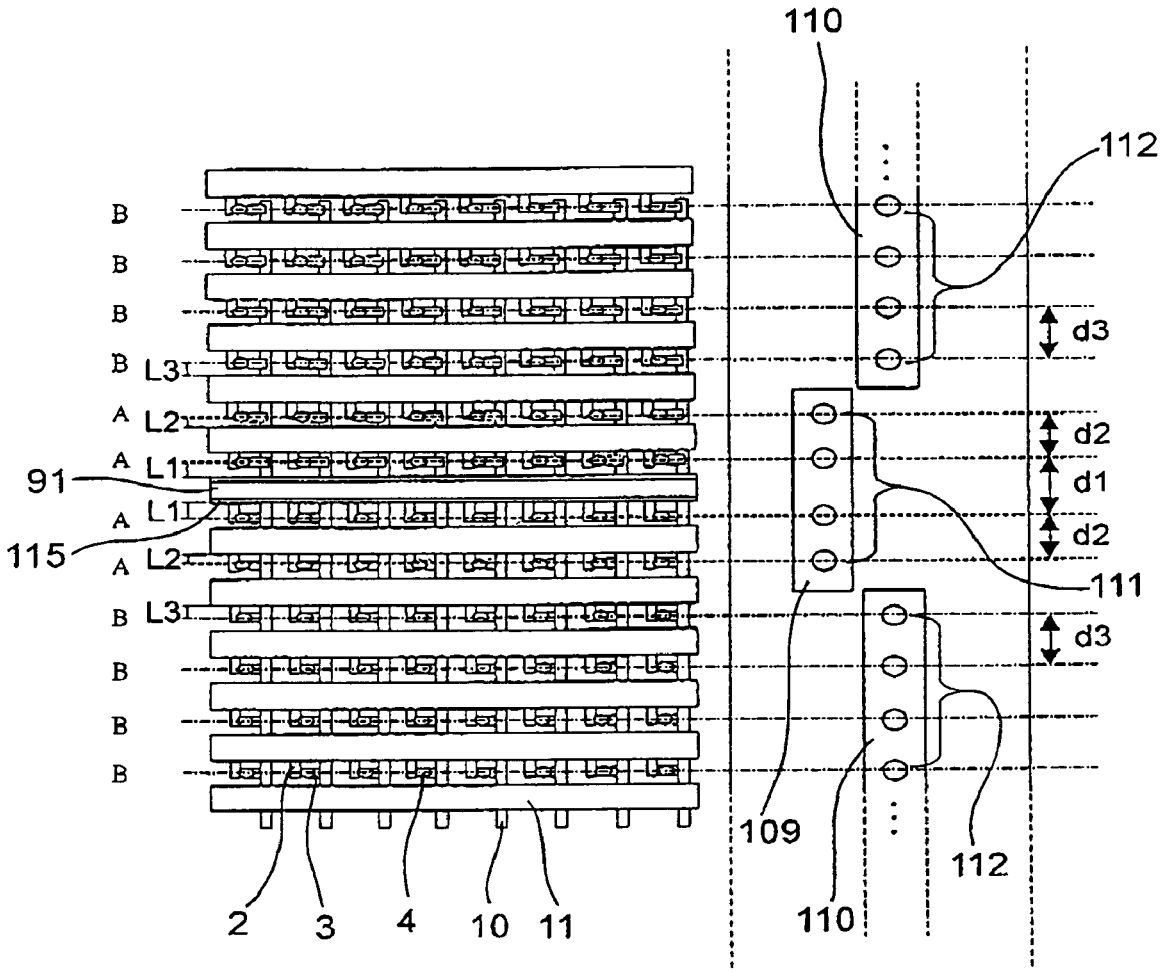
FIG. 13 is a schematic diagram showing an electron source substrate according to a second embodiment of the invention and an ink jet device to be used for manufacturing the electron source substrate.

Next, a second embodiment of the invention will be described with reference to FIG. 13.

In this embodiment, for the element electrode pairs arranged near the fixed position of the spacer, there is used an ink jet device that has a nozzle arrangement different from that used for the element electrode pairs. The remaining constructions and actions pertaining to the remaining element electrode pairs are similar to those of the first embodiment so that the detailed description of the portions having similar constructions is omitted.

As has been described, the electrons emitted from the electron emission elements on the first and second adjacent rows in the vicinity of the spacer are curved in their orbits by the influences of the spacer charge. It has been found that the curving direction approaches the spacer, and that the curvature is larger on the first adjacent row than on the second adjacent row. Considering the curvature of the electron orbits caused by the spacer charge, therefore, the positions of the electron emission elements on the first and second adjacent rows are adjusted in advance. Thus, it is possible to eliminate the distortion of the display image.

In this embodiment, the nozzle arrangement of the ink jet device 109 to be used for the element electrode pairs (located on the rows indicated by A in FIG. 13) arranged in the vicinity of the fixed position of the spacer is set in the following manner. Specifically, as shown in FIG. 13, the nozzle distance d1 of the two nozzles 111 and 111 at the central portion for applying the liquid droplets to the element electrode pairs of the first adjacent row and the nozzle distance d2 between the nozzle 111 for applying the liquid droplets to the element electrode pairs of the first adjacent row and the nozzle 111 for applying the liquid droplets to the element electrode pairs of the second adjacent row are set to satisfy a relation of d1>d2. In other words, the nozzles 111 of the ink jet device 109 are so unequally arranged that their nozzle distances may consciously be different according to the adequate positions where the electron emission portions are formed.

On the other hand, the ink jet devices 110 used are similar to those of the first embodiment, and their nozzle distance d3 is equal (despite a dispersion in the working accuracy). It is preferable to use the ink jet device 109 which is excellent in drop placement accuracy and drop volume accuracy, and it is sufficient to use the ink jet devices 110 having inferior performances.

Here: the distance d1 was set to 205 μm; the distance d2 to 145 μm; and the distance d3 to 205 μm. With these ink jet devices 109 and 110, the conductive thin film 4 was formed as in the first embodiment. The distance L1 between the X-direction wire 115 having the spacer arranged thereon and the center of the electron emission portion of the first adjacent row was 170 μm, and the distance L2 between the X-direction wire adjacent to the X-direction wire 115 and the center of the electron emission portion of the second adjacent row was 140 μm, so that the electron emission elements having the positional relation of L1>L2 could be formed. Here, the distance L3 was 170 μm.

The image display device using the electron source substrate thus manufactured was driven. Both the electron beams from the electron emission portions of the first and second adjacent rows were curved in their orbits toward the spacer. As a result, the distances between the fluorescent points by the individual electron beams were substantially equalized to display an image of a high quality having no distortion.

According to the construction of this embodiment, it is possible to acquire actions and effects similar to those of the foregoing first embodiment. In addition, the ink jet device 109 having the unequal arrangement of the nozzle distances is used so that the electron emission portion in the vicinity of the spacer, as required to have the special positional relation for correcting the electron orbits, can be manufactured as a whole to realize the shortening of the manufacturing procedure and the reduction of the cost.

Third Embodiment

Figure 14:
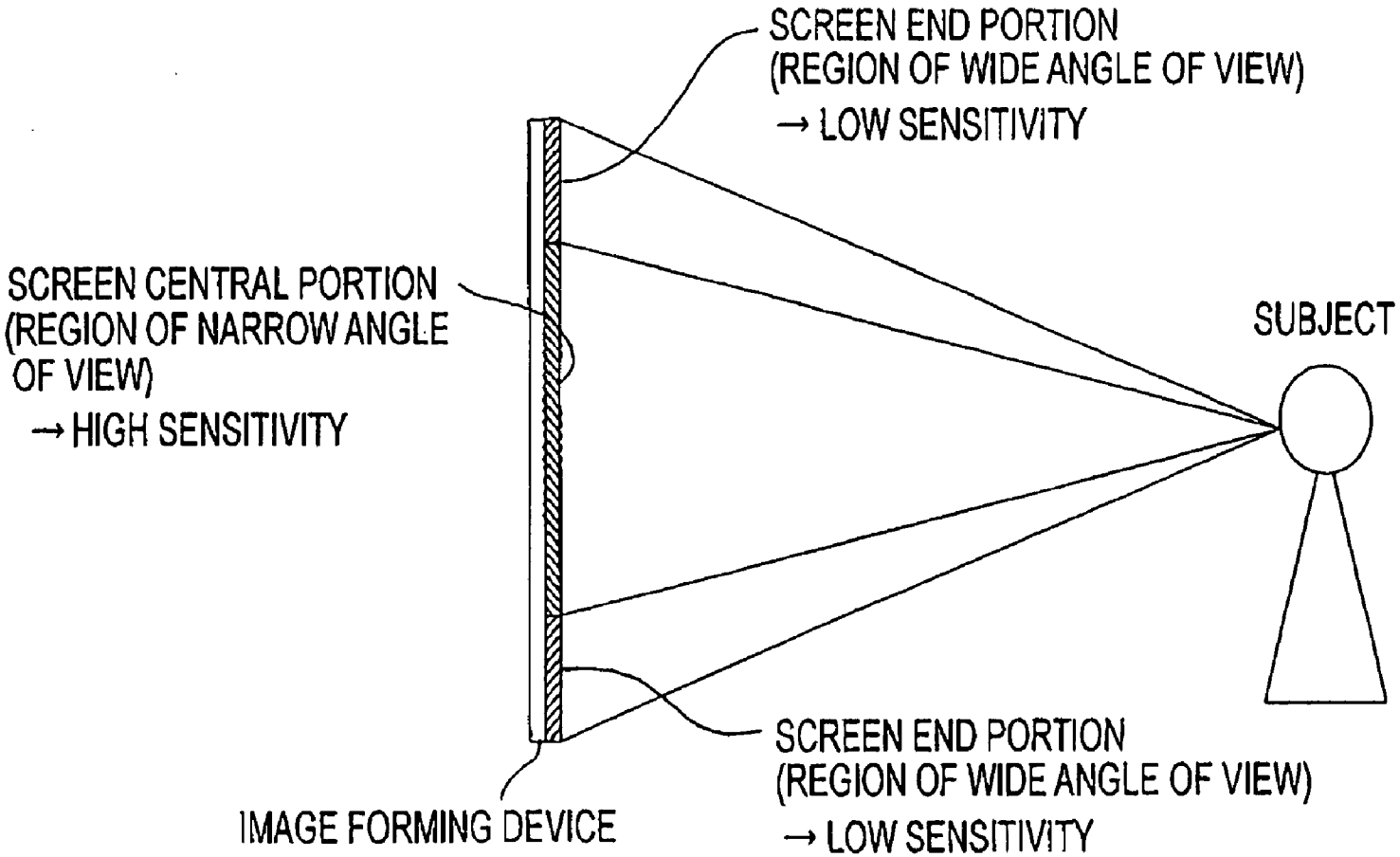
FIG. 14 is a schematic diagram for explaining the sensitivity of a (human) subject to a displayed image.

Next, a third embodiment of the invention will be described with reference to FIGS. 14 and 15.

In this embodiment, for the element electrode pairs arranged at the central portion of the screen, there is used an ink jet device of a kind different from that used for the element electrode pairs arranged at the end portions of the screen. The constructions and actions pertaining to the element electrode pairs arranged at the end portions of the screen are similar to those pertaining to the remaining element electrode portions of the first embodiment so that the detailed description of the portions having similar constructions is omitted.

The sensitivity of a human subject to the display screen is not identical for all positions on the screen. According to the experiments, as shown in FIG. 14, it has been found that the sensitivity of a subject is the highest for the region within a narrow angle of view (i.e., at the central portion of the screen) and becomes lower as the position viewed approaches the region of a wide angle of view (i.e., the end portion of the screen). In other words, the subject does not appreciate that the screen end portion region has a poorer image quality than that of the screen central portion region.

Figure 15:
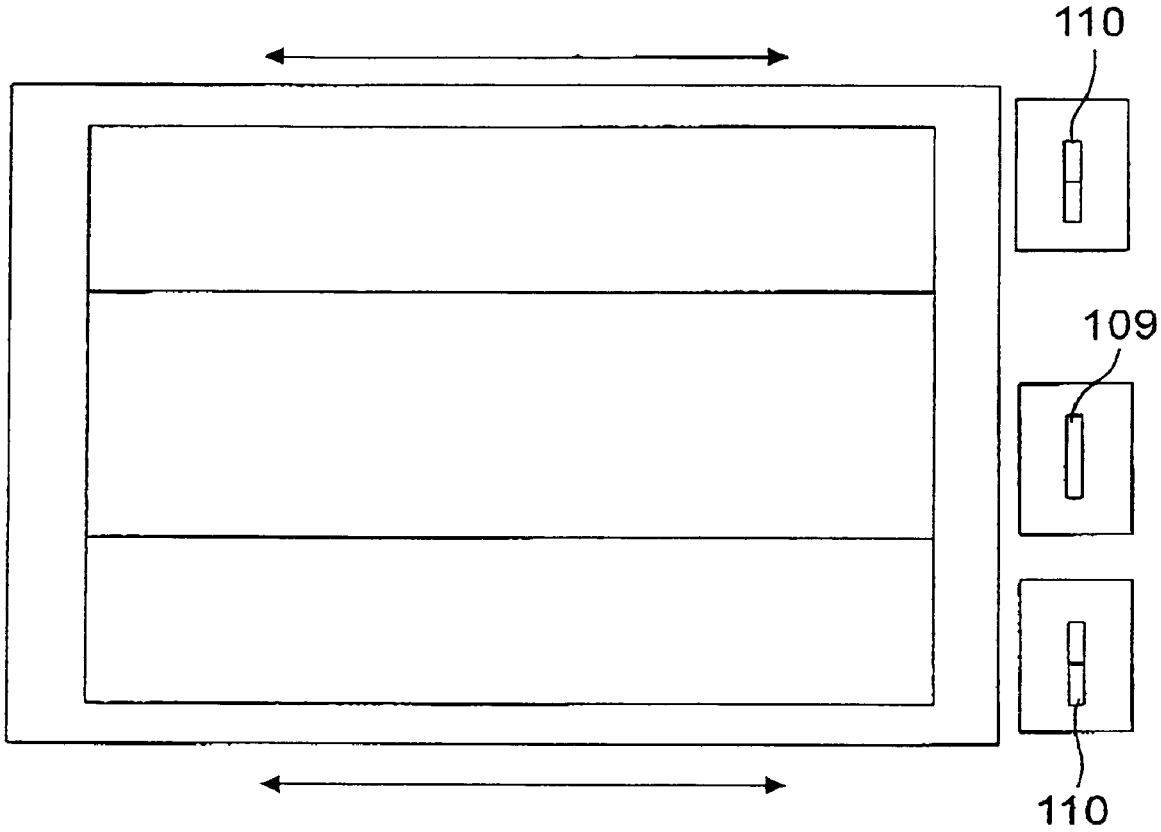
FIG. 15 is a schematic diagram showing an electron source substrate according to a third embodiment of the invention and an ink jet device to be used for manufacturing the electron source substrate.
Figure 16:
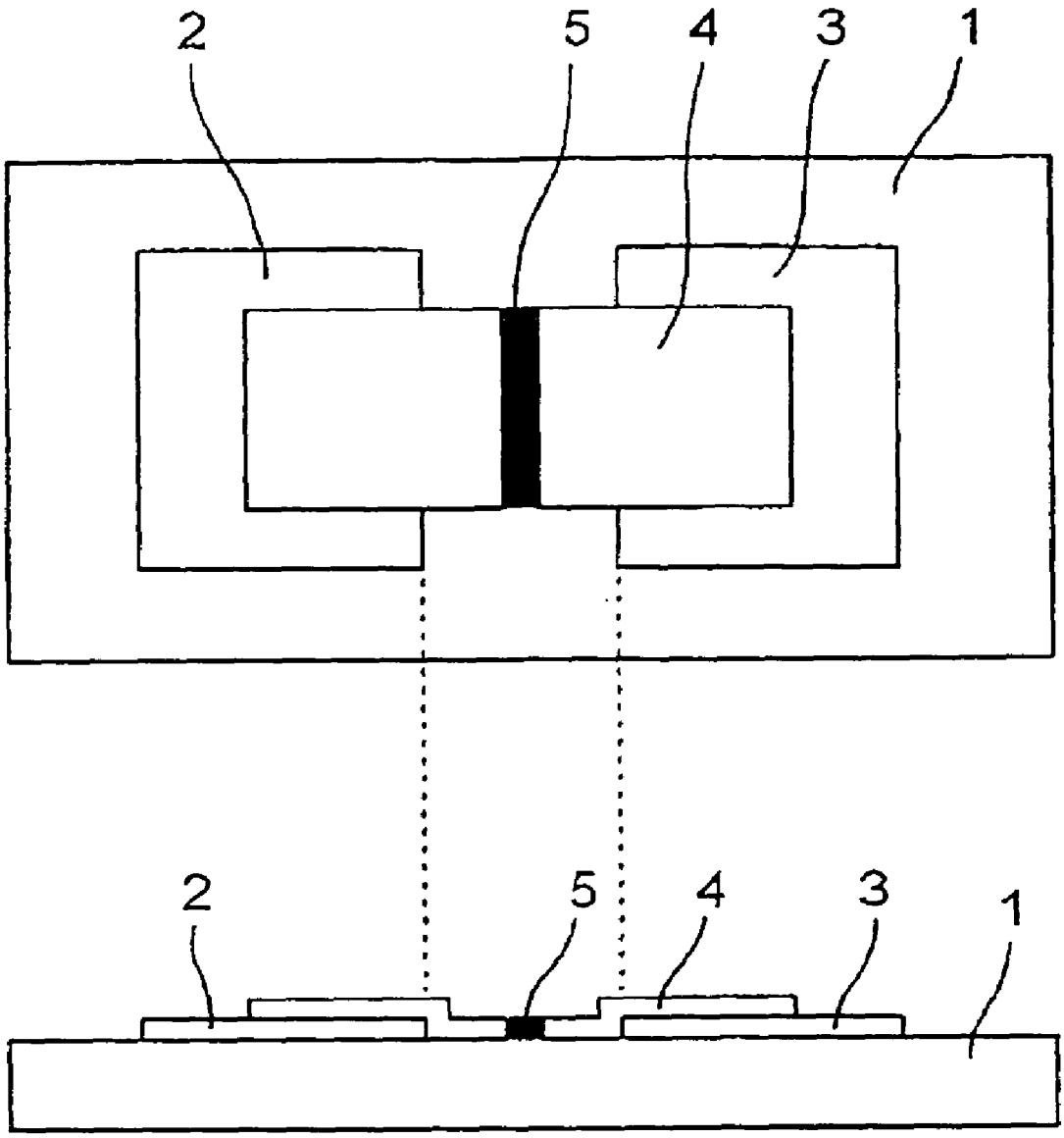
FIG. 16 is a diagram showing a typical element construction of a surface-conduction electron-emitting element.

In this embodiment, therefore, the conductive liquid droplets are applied at least to the element electrode pairs arranged at the central portion of the screen by using the ink jet device 109 having superior performances in drop volume accuracy and drop placement accuracy, as shown in FIG. 15, but the conductive liquid droplets are applied to the element electrode pairs arranged at the end portions of the screen by using the ink jet devices 110 having performances inferior to those of the ink jet device 109.

The three ink jet devices 110, 109 and 110 are separate from each other but are so simultaneously driven as to manufacture the electron emission elements at the screen upper end portion, the screen central portion and the screen lower end portion as a whole. As a result, it is possible to realize a high throughput.

For the element electrode pairs arranged at the screen central portion, moreover, the ink jet device 109 having the excellent performances is used so that the electron emission portion of the corresponding region can be manufactured to a high positional accuracy. As a result, it is possible to particularly improve the image quality of the region to which human eyes have a high sensitivity.

Moreover, the electron source substrate can be manufactured without using a lot of costly ink jet devices, such as the ink jet device 109, which has high accuracy and causes the manufacturing cost to rise.

Moreover, by manufacturing the electron emission elements for the portions required to have high positional accuracy and the portions not required to have high positioned accuracy, using ink jet devices of different kinds, respectively, many nozzles can be simultaneously used to realize the shortening of the manufacturing procedure and the lowering of the cost.

Other Embodiments

In the foregoing individual embodiments, the element electrodes and wires of the MTX substrate are manufactured by using a photolithographic technique, which may preferably be replaced by a screen printing method. The steps of forming the remaining conductive thin film and electron emission portion are similar to those of the foregoing embodiments. As a result, the cost can be suppressed to a greater degree than is the case for the thin film process, and the production yield is remarkably improved.

EXAMPLES

One preferred example of the invention will now be described in detail, but the invention is not limited to this example. Here, the description is made by using the common reference numerals with reference to the drawings used in the foregoing individual embodiments.

First of all, the insulating substrate 1 was exemplified by the glass PD-200 (made by Asahi Glass Kabushiki Gaisha) containing little alkaline component and having a thickness of 2.8 mm. A $SiO_2$ film of 100 nm was applied to the glass and was baked as a sodium block layer. The substrate was sufficiently rinsed with an organic solvent or the like and was dried at 120° C.

Next, a titanium T1 film of 5 nm was formed as an undercoating layer over the insulating substrate 1, and a platinum Pt film of 40 nm was formed over the former layer, by a sputtering method. After this, a photoresist was applied and was patterned by a photolithographic method having a series of exposing, developing and etching steps thereby to form the element electrodes 2 and 3 (FIG. 5). By the same method, the Y-direction wires 10 of Au were formed (FIG. 6). At this time, the element electrodes 2 and 3 had a gap distance of 20 μm, an electrode width of 500 μm, a thickness of 50 nm (i.e., 500 angstroms) and an element pitch of 1 mm. The Y-direction wires 10 had a width of 300 μm and a thickness of 50 nm (i.e., 500 angstroms).

Subsequently, in order to insulate the upper and lower wires, a vacuum filming technique and a photolithographic technique were used to arrange the interlayer insulating layer 6. Contact holes were opened at the connecting portions (FIG. 7) so as to cover the intersecting portions of the X-direction wires (i.e., the upper wires) 11 and the Y-direction wires (i.e., the lower wires) 10 and to connect the X-direction wires 11 and the element electrodes 2 electrically.

By using the vacuum filming technique and the photolithographic technique, moreover, there were formed the X-direction wires 11 of Au, which were connected with the element electrodes 2 (FIG. 8). The wires had a width of 20 nm (i.e., 200 angstroms) and a thickness of 500 nm (i.e., 5,000 angstroms).

Next, the ink jet devices 109 and 110 were used to apply an organic palladium-containing solution, droplet by droplet, to cover the element electrodes 2 and 3. The organic palladium-containing solution used was prepared by dissolving a palladium-proline complex into an aqueous solution of water and isopropyl alcohol (IPA) and by adding a small quantity of additive.

At this time, the ink jet device 109 used had the four nozzles 111, and the ink jet devices 110 used had the twenty nozzles 112. Moreover, the nozzles constructing the ink jet device 109 were so accurate that the liquid droplets discharged therefrom were ±3 μm or less with respect to a predetermined position over the MTX substrate, and the nozzles constructing the ink jet devices 110 had such a relatively low accuracy that the liquid droplets discharged therefrom were ± about 10 μm with respect to a predetermined position over the MTX substrate.

At the time of applying the liquid droplets, as shown in FIG. 9A, the liquid droplets 8 were always applied to the region 113 near the spacer by using the ink jet device 109 and to the remaining region 114 by using the ink jet devices 110, so that the electron emission elements near the spacer were formed in the with high positional accuracy.

After this, heat treatment at 300° C. was performed for 10 minutes to form the fine particle film of fine particles of palladium oxide (PdO) as the conductive thin film 4 (FIG. 10). One liquid droplet was controlled to 60 $\mu m^3$.

Next, voltage was applied between the element electrodes 2 and 3 so that the conductive thin film 4 was subjected to the energization treatment (i.e., the energization forming) to form the electron emission portion 5.

The electron source substrate thus manufactured was used to construct the envelope 90 of the face plate 82, the support frame 86, the rear plate 81 and the spacer 91, and the device was sealed to manufacture the display panel and the image forming device having a drive circuit for TV display based on the TV signals of the NTSC system.

At this time, the position for mounting the spacer 91 was located in the region 113, which was manufactured by the aforementioned ink jet device 109. As a result, the positions of the electron emission elements on the first and second adjacent rows in the vicinity of the spacer were able to be arranged with an accuracy of ±6 μm, so that the distortion of the image could be reduced to a visually unnoticeable level, with the curvature of the beam due to the charge of the spacer being taken into account.

The electron emission elements thus manufactured by the manufacturing method of this example not only exhibited satisfactory characteristics having no problem but also could reduce the distortion of the image due to the spacer charge to a visually unnoticeable level thereby to form an image of a high quality.

Moreover, by manufacturing the electron emission elements at the portions required to have high accuracy and the portions not required to have high accuracy using different ink jet devices, respectively, a number of nozzles could be used simultaneously, whereby the manufacturing procedure could be shortened and performed at a low cost.

What is claimed is:

1. A method for manufacturing an electron source substrate configured so that an anode member confronts a spacer, comprising the steps of:

forming a plurality of electrode pairs over a substrate, each electrode pair comprising two individual electrodes;

forming conductive films by applying liquid droplets containing a conductive substance between the individual electrodes of each electrode pair, using a plurality of ink jet heads; and forming an electron emission portion in each of the conductive films, wherein, at least for those of the electrode pairs arranged in the vicinity of the spacer, the liquid droplets are applied by an ink jet head of a kind different from that used for the other electrode pairs.

2. The method according to claim 1, wherein the ink jet head that is used at least for the electrode pairs arranged in the vicinity of the spacer has a higher performance than that used for the other electrode pairs.

3. The method according to claim 2, wherein the ink jet head that is used at least for the electrode pairs arranged in the vicinity of the spacer has a higher drop placement accuracy than that used for the other electrode pairs.

4. The method according to claim 2, wherein the ink jet head that is used at least for the electrode pairs arranged in the vicinity of the spacer has a higher drop volume accuracy than that used for the other electrode pairs.

5. The method according to claim 1, wherein the ink jet head that is used at least for the electrode pairs arranged in the vicinity of the spacer has a nozzle arrangement different from that of the ink jet head used for the other electrode pairs.

6. The method according to claim 1, wherein the ink jet head that is used at least for the electrode pairs arranged in the vicinity of the spacer has fewer nozzles than that used for the other electrode pairs.

7. The method according to claim 1, wherein the liquid droplets are substantially simultaneously applied to the electrode pairs arranged in the vicinity of the spacer and the other electrode pairs.

8. The method according to claim 1, wherein there is used a unit, in which individual ink jet heads of a plurality of kinds are connected.

9. The method according to claim 8, wherein in the unit used, the ink jet heads for the other electrode pairs are individually fixed on two sides of the ink jet head for the electrode pairs arranged in the vicinity of the spacer.

10. The method according to claim 9, wherein the liquid droplets are applied while the unit and/or the substrate are being moved relative to one another along the direction in which the spacer is arranged.

11. A method for manufacturing an electron source substrate to be used in an image display device, comprising the steps of:

forming a plurality of electrode pairs over a substrate, each electrode pair comprising two individual electrodes;

forming conductive films by applying liquid droplets containing a conductive substance between the individual electrodes of each electrode pair, using a plurality of ink jet heads; and forming an electron emission portion in each of the conductive films, wherein, at least for those of the electrode pairs arranged at a central portion of a screen of the image display device, the liquid droplets are applied by an ink jet head of a kind different from that used for those of the electrode pairs arranged at an end portion of the screen of the image display device.

12. The method according to claim 11, wherein the ink jet head that is used at least for the electrode pairs arranged at the central portion of the screen has a higher performance than that used for the electrode pairs arranged at the end portion of the screen.

13. The method according to claim 12, wherein the ink jet head that is used at least for the electrode pairs arranged at the central portion of the screen has a higher drop placement accuracy than that used for the electrode pairs arranged at the end portion of the screen.

14. The method according to claim 12, wherein the ink jet head that is used at least for the electrode pairs arranged at the central portion of the screen has a higher drop volume accuracy than that used for the electrode pairs arranged at the end portion of the screen.

15. The method according to claim 11, wherein the ink jet head that is used at least for the electrode pairs arranged at the central portion of the screen has fewer nozzles than that used for the electrode pairs arranged at the end portion of the screen.

16. The method according to claim 11, wherein the liquid droplets are substantially simultaneously applied to the electrode pairs arranged at the central portion of the screen and the electrode pairs arranged at the end portion of the screen.

17. A method for manufacturing an electron source substrate, comprising the steps of:

forming a plurality of electrode pairs over a substrate, each electrode pair comprising two individual electrodes;

forming conductive films by applying liquid droplets containing a conductive substance between the individual electrodes of each electrode pair, using a plurality of kinds of ink jet heads; and forming an electron emission portion in each of the conductive films.

18. A method for manufacturing an electron source substrate, comprising the steps of:

forming a plurality of electrode pairs over a substrate, each electrode pair comprising two individual electrodes;

forming conductive films by applying liquid droplets containing a conductive substance between the individual electrodes of each electrode pair, using a unit in which individual ink jet heads of a plurality of kinds are connected; and forming an electron emission portion in each of the conductive films.

19. A method for manufacturing an electron source substrate, comprising the steps of:

forming a plurality of electrode pairs over a substrate, each electrode pair comprising two individual electrodes;

forming conductive films by applying liquid droplets containing a conductive substance between the individual electrodes of each electrode pair, using a plurality of ink jet heads; and forming an electron emission portion in each of the conductive films, wherein, for those of the electrode pairs arranged in a predetermined region, the liquid droplets are applied by an ink jet head of a kind different from that used for those of the electrode pairs arranged at other regions.

* * * * *

UNITED STATES PATENT AND TRADEMARK OFFICE

CERTIFICATE OF CORRECTION

PATENT NO. : 7,037,158 B2
APPLICATION NO. : 10/665425
DATED : May 2, 2006
INVENTOR(S) : Seiji Mishima et al.

It is certified that error appears in the above-identified patent and that said Letters Patent is hereby corrected as shown below:

ON THE COVER PAGE
(Item 56), U.S. Patent Documents, "6,836,304 B1" should read --6,836,304 B2--.

(Item 57), Abstract, "spacer" should read --spacer,--.

COLUMN 1
Line 15, "kinds" should read --kinds:--.

COLUMN 2
Line 8, "spacers" should read --spacer--.

COLUMN 3
Line 50, "n ink" should read --an ink--.
Line 54, "cations" should read --cations,--.

COLUMN 5
Line 18, "tens" should read --tens of--.

COLUMN 8
Line 3, "next" should be deleted.

COLUMN 9
Line 33, "10" should read --110--.
Line 38, "in the" should be deleted.
Line 43, "10," should read --110,--.

COLUMN 10
Line 18, "element" should read --remaining element--, and "remain" should be deleted.
Line 19, "ing" should be deleted.

UNITED STATES PATENT AND TRADEMARK OFFICE

CERTIFICATE OF CORRECTION

PATENT NO. : 7,037,158 B2
APPLICATION NO. : 10/665425
DATED : May 2, 2006
INVENTOR(S) : Seiji Mishima et al.

It is certified that error appears in the above-identified patent and that said Letters Patent is hereby corrected as shown below:

COLUMN 14
Line 44, "wherein" should read --wherein,--.

Signed and Sealed this

Thirtieth Day of January, 2007

JON W. DUDAS
*Director of the United States Patent and Trademark Office*